United States Patent [19]

Tobita et al.

[11] 4,279,233

[45] Jul. 21, 1981

[54] DEVICE FOR TRAPPING FUEL VAPOR VAPORIZED IN FUEL FEED SYSTEM OF INTERNAL COMBUSTION ENGINE

[75] Inventors: Yuichi Tobita; Masamitsu Okumura, both of Katsuta, Japan

[73] Assignee: Hitachi, Ltd., Tokyo, Japan

[21] Appl. No.: 41,319

[22] Filed: May 22, 1979

[30] Foreign Application Priority Data

May 22, 1978 [JP] Japan ..... 53-59938

[51] Int. Cl.[3] ..... F02M 25/08

[52] U.S. Cl. ..... 123/519

[58] Field of Search ..... 123/136; 220/85 VR, 220/85 VS; 55/387, DIG. 28

[56] References Cited

U.S. PATENT DOCUMENTS

| | | | |
|---|---|---|---|
| 3,352,294 | 11/1967 | Biller et al. | 123/136 |
| 3,628,517 | 12/1971 | Soberski | 123/136 |
| 3,884,204 | 5/1975 | Krautwurst et al. | 123/136 |

OTHER PUBLICATIONS

SEA Article, "Chrysler Evaporation Control System, The Vapor Saver for 1970", by J. O. Sarto, W. S. Fagley, and W. A. Hunter, Jan. 12–16, 1970.

*Primary Examiner*—Tony M. Argenbright

*Attorney, Agent, or Firm*—Craig and Antonelli

[57] ABSTRACT

A fuel vapor trapping device for trapping the fuel vapors evaporated in a fuel feed system such as a float chamber of a carburetor and a fuel tank of an internal combustion engine, said device comprising a first canister whose one end is communicated with the float chamber and the high suction in the carburetor and whose the other end is communicated with the surrounding atmosphere and which is filled with a first absorbent capable of absorbing the vapors of hydrocarbons having carbon numbers up to and including seven ($C_7$), and a second canister whose one end is communicated with the fuel tank and with the high suction in the carburetor and whose the other end is communicated with the surrounding atmosphere and which is filled with a second absorbent capable of absorbing the vapors of hydrocarbons having the carbon numbers up to and including four ($C_4$). A single canister type is also disclosed wherein the first and second canisters are constructed as a unitary assembly.

5 Claims, 2 Drawing Figures

DEVICE FOR TRAPPING FUEL VAPOR VAPORIZED IN FUEL FEED SYSTEM OF INTERNAL COMBUSTION ENGINE

BACKGROUND OF THE INVENTION

1. Field of the Invention

The present invention relates to generally a device for preventing the emission into the surrounding atmosphere of the fuel vapor evaporated in the fuel feed system of the internal combustion engines and more particularly an improvement of canister means which are filled with absorbents adapted to absorb the fuel vapor.

2. Description of the Prior Art

Because of the increasingly strict enforcements of the controls on the emission or discharge of fuel vapors into the surrounding atmosphere, it is now necessary to trap or absorb not only the fuel vapor generated in the fuel tanks but also the fuel vapors in the float chambers. To this end, there have been devised and demonstrated a variety of fuel vapor trapping devices. For instance, U.S. Pat. No. 3,628,517 discloses a fuel vapor trapping device of the type having a canister which is filled with activated carbon for trapping the fuel vapors and whose upper space is communicated through a first line with a fuel tank so as to feed the fuel vapors in the fuel tank into the canister, with a float chamber through a second line so as to feed the fuel vapors in the float chamber into the canister and with the high suction in a carburetor through a third line, the lower end of the canister being communicated with the surrounding atmosphere. U.S. Pat. No. 3,884,204 also discloses a fuel vapor trapping device of the type having a first canister which is substantially similar in construction and mode of operation to the canister disclosed in U.S. Pat. No. 3,628,517 and a second canister which is greater in capacity than the first canister and which is so designed and constructed as to be communicated with a fuel tank only when the fuel is fed into the tank.

The float chamber of the carburetors is in general located in the vicinity of the engine so that even after the engine has been stopped, the engine still remains at relatively high temperatures and therefore fuel in the float chamber is heated to a high temperature. For instance, the temperature of the float chamber may reach as high as 80° C. or higher. As a result even the low volatile part of the fuel; that is, the hydrocarbons having a carbon number of seven ($C_7$) which has a relatively high boiling point is vaporized in the float chamber. On the other hand, the temperature of the fuel tank is in general dependent upon the ambient temperature so that the hydrocarbons having relatively low carbon numbers of four or less are evaporated in the fuel tank. In the prior art fuel vapor trapping devices, the canisters are in general filled with the absorbent such as activated carbon capable of satisfactorily absorbing the vapors of the hydrocarbons having relatively low carbon numbers of four, or less, but incapable of absorbing or trapping the vapors of hydrocarbons having relatively high carbon numbers of from five to seven. As a result with the fuel vapor trapping devices of the types disclosed in the above U.S. Patents, the activated carbon in the canister cannot absorb or trap the vapors of the relatively high carbon-numbered hydrocarbons evaporated in the float chamber.

Recently by improving the shape of the entrances of the numerous minute holes formed in the surfaces of activated carbon grains of activated carbon which can absorb or trap vapors of hydrocarbons having carbon numbers up to seven has been developed, but is expensive as compared with the prior art activated carbon. In addition the new activated carbon and the prior art activated carbon are different from each other in particle size as well as in specific weight so that it is extremely difficult to uniformly mix them and pack the mixture in a single canister so as to absorb all the vapors of hydrocarbons having carbon numbers up to and including seven ($C_7$).

SUMMARY OF THE INVENTION

Accordingly the present invention has for its object to provide a fuel vapor trapping device for trapping the fuel vapors evaporated not only in a float chamber but also in a fuel tank, thereby avoiding the emission of the fuel vapor into the surrounding atmosphere.

The present invention features in the construction including a first canister device which has its one end communicated not only with the space above the fuel level in the float chamber but also the high suction in a carburetor and its the other end communicated with the surrounding atmosphere and which is filled with a first absorbent capable of absorbing or trapping the vapors of the hydrocarbons upto and including those with high carbon numbers; and a second canister device which has its one end communicated not only with the space above the fuel level in the fuel tank but also with the high suction in the carburetor and its the other end communicated with the surrounding atmosphere and which is filled with a second absorbent capable of absorbing or trapping the vapors of the hydrocarbons having relatively low carbon numbers.

With this arrangement, the fuel vapors in the float chamber and the fuel tank can be completely absorbed or trapped by the first and second absorbents in the first and second canister devices so that the emission or discharge of the fuel vapors into the surrounding atmosphere may be completely eliminated. Furthermore when negative pressure is produced in the high suction in the carburetor, the trapped fuel vapors are desorbed and fed into the engine so that waste of the fuel vapors may be avoided.

According to another aspect of the present invention, a fuel vapor trapping device may be provided wherein the first and second canister devices are constructed as a unitary assembly. That is, a single canister is divided into a first absorbent chamber and a second absorbent chamber. The first absorbent chamber has its one end communicated with the space above the fuel level in the float chamber and with the high suction in the carburetor and its the other end communicated with the surrounding atmosphere and is filled with a first absorbent capable of absorbing or trapping the vapors of the hydrocarbons upto and including those with high carbon numbers. The second absorbent chamber has its one end communicated with the space above the fuel level in the fuel tank and the high suction in the carburetor and its the other end communicated with surrounding atmosphere and is filled with a second absorbent capable of absorbing or trapping the vapors of the hydrocarbons having relatively low carbon numbers.

The fuel vapor trapping devices in accordance with the second arrangement may be made more compact in size and fabricated at lower costs than the first arrangement.

BRIEF DESCRIPTION OF THE DRAWINGS

Similar reference numerals are used to designate similar parts throughout the figures.

DESCRIPTION OF THE PREFERRED EMBODIMENTS

Figure 1:
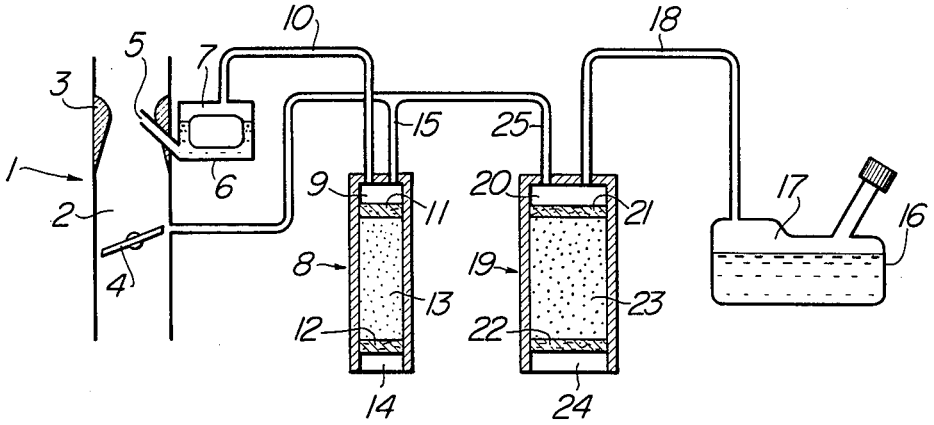
FIGS. 1 and 2 are schematic diagrammatic views of first and second embodiments, respectively, of the present invention.

Referring to FIG. 1, a venturi throat 3 and a throttle valve 4 are disposed within an intake air passage 2 of a carburetor 1. A main nozzle 5 which opens at the venturi throat 3 is communicated with a float chamber 6 at a position below the level of the fuel in the float chamber 6. An upper space 7 in the float chamber 6 is communicated through a communication line 10 with an upper space 9 in a first canister device 8. First activated carbon 13 is filled in the first canister device 8 between upper and lower filters 11 and 12 so that hydrocarbons with carbon numbers of seven or less may be trapped. 14 is a vent of this canister device. A communication line 15 is also connected to the upper space 9, and the other end of this communication line or pipe is opened at the intake air passage 2 in the vicinity of the throttle valve 4. Because of the arrangement described above, the upper space 7 in the float chamber 6 is always communicated with the surrounding atmosphere through the communication line or pipe 10, the upper space 9 in the first canister device 9, the upper filter 11, the first activated carbon 13, the lower filter 12 and the vent hole 14.

A communication line or pipe 18 is connected to the upper space 17 in a fuel tank 16, and the other end of the communication line or pipe 18 is opened at the upper space 20 in a second canister device 19. Second activated carbon 23 is filled in the second canister device 19 between upper and lower filters 21 and 22 so that hydrocarbons carbons with carbon numbers of four or less may be trapped. 24 is a vent (hole) of the second canister device 19. A communication line or pipe 25 is connected to the upper space 20 and is joined to the communication line or pipe 15 of the first canister device 8 and opened at the intake air passage 2 in the vicinity of the throttle valve 4. Because of the arrangement described above, the upper space in the fuel tank 16 is always communicated with the surrounding atmosphere through the communication line or pipe 18, the upper space 20 in the second canister device 19, the upper filter 21, the second activated carbon 23, the lower filter 22 and the vent hole 24.

Next the mode of operation of the evaporated fuel vapor trapping device with the construction described above will be explained.

Since the float chamber 6 of the carburetor 1 is positioned in the vicinity of an engine, its temperature becomes relatively high so that hydrocarbons having relatively high boiling points of the fuel in the float chamber 6; that is, hydrocarbons having higher carbon numbers are evaporated. The fuel vapor flows through the communication line or pipe 10 into the first canister device 8 and is absorbed by the first activated carbon 13. Especially when the engine is stopped after a hard run, the fuel within the float chamber 6 rises to high temperatures. For instance, the temperature of the float chamber 6 may reach 80° C. or higher. As a result hydrocarbons having relatively high carbon numbers up to seven are evaporated, but the first activated carbon 13 has the ability of absorbing them so that the discharge or emission of these hydrocarbons into the surrounding atmosphere may be avoided. When the engine is restarted, the negative pressure acts on the first canister device 8 through the communication line or pipe 15 which is opened at the intake air passage 2 in the vicinity of the throttle valve 4 so that the atmospheric air is sucked through the vent hole 14 into the first canister device 8. In this case, the fuel vapor which has been absorbed by the first activated carbon 13 is desorbed and flows together with the air into the intake air passage 2 through the communication line or pipe 15 so that the fuel vapor joins the fuel mixture supplied from the carburetor 1, is charged into the engine and burned.

The fuel tank 16 is located remote from the engine so that the temperature of the fuel in the fuel tank 16 will not rise as high as the temperature of the fuel in the float chamber 6. Therefore hydrocarbons having carbon numbers of four or less; that is, hydrocarbons having relatively low boiling temperatures or high volatality are evaporated in the fuel tank 16. Since the second activated carbon 23 filled in the second canister device 19 has the ability of absorbing the hydrocarbons having carbon numbers of four ($C_4$) or less and because the second canister device 19 has a volume larger than the first canister device 8 as shown in FIG. 1, even when a large quantity of fuel vapor is generated in the fuel tank 16, the second activated carbon 23 absorbs it so as to avoid its discharge into the surrounding atmosphere. When the engine is restarted, the negative pressure acts on the second canister device 19 through the communication line or pipe 25 so that the fuel vapor absorbed by the second activated carbon 23 is desorbed, joins with the air sucked through the vent opening 24 and flows into the intake air passage 2 through the communication line or pipe 25 so as to be utilized as fuel for the engine. When a large quantity of the fuel vapor is supplied from the first and second canister devices 8 and 19 into the intake air passage 2, the fuel mixture to be charged into the engine becomes too rich and consequently the contents of the hydrocarbons contained in the exhaust gases will increase. Therefore suitable fuel vapor flow rate control means must be inserted in the communication lines or pipes 15 and 25 at suitable positions. However such flow control means are out of the scope of the present invention so that no further description shall be made in this specification.

Figure 2:
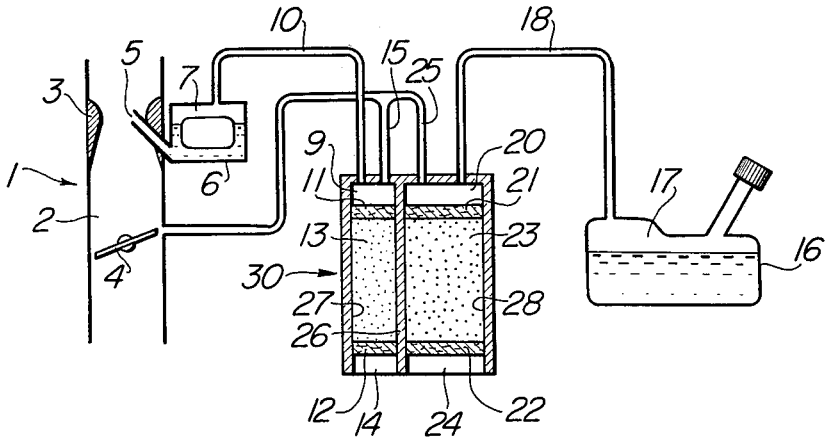

The second embodiment of the present invention shown in FIG. 2 is substantially similar in construction to the first embodiment described above with reference to FIG. 1 except that the first and second canister device are combined into a unitary construction.

A single canister device 30 is divided by a partition wall 26 into first and second absorbent chambers 27 and 28. The upper space 9 in the first absorbent chamber 27 is communicated through the communication line or pipe 10 with the upper space 7 in the float chamber 6 and further communicated through the communication line or pipe 15 with the intake air passage 2 in the vicinity of the throttle valve 4. The first activated carbon 13 is filled in the first absorbent chamber 27 between the upper and lower filters 11 and 12 so that vapors of the hydrocarbons having carbon numbers up to and including seven ($C_7$) may be absorbed. The first absorbent chamber 27 has a vent opening or hole 14.

The upper space 20 in the second absorbent chamber 28 is communicated with the upper space 17 in the fuel tank 16 through the communication line or pipe 18. The communication line or pipe 25 is also connected to the upper space 20 and joined to the communication line 15 to open at the intake air passage 2 in the vicinity of the throttle valve 4. The second activated carbon 23 which is filled in the second absorbent chamber 28 between the upper and lower filters 21 and 22 is capable of absorbing vapors of hydrocarbons having carbon numbers of four ($C_4$) or less. The second absorbent chamber 28 has a vent 24.

The mode of operation of the first absorbent chamber 27 is substantially similar to that of the first canister device 8 of the first embodiment while the mode of operation of the second absorbent chamber 28 is substantially similar to that of the second canister device 19 so that no further description shall be made in this specification.

In the case of the single canister construction, its design and construction may be more simplified by eliminating the partition wall 26 and filling the mixture of the first and second activated carbons 13 and 23 into the common absorbent chamber. However as previously described the first activated carbon 13 which is capable of absorbing the vapors of hydrocarbons having carbon numbers up to and including seven ($C_7$) and the second activated carbon 23 which is capable of absorbing the vapors of hydrocarbons having carbon numbers of four ($C_4$) or less are different in particle size as well as specific weight so that it will be extremely difficult, if not impossible, to obtain a uniform mixture of the first and second activated carbons 13 and 23. With a nonuniform mixture of the first and second activated carbons 13 and 23, it would be next to impossible to completely trap the fuel vapor. This is the reason why the single canister of the second embodiment is divided by the partition wall 26 into the first and second absorbent chambers 27 and 28 so that the first and second activated carbons 13 and 23 may be filled separately.

In summary, the evaporated fuel vapor trapping device in accordance with the present invention has a first canister device communicated with a float chamber and a second canister device in communication with a fuel tank. Alternatively, it has a single canister device which is divided into a first absorbent chamber in communication with a float chamber and a second absorbent chamber in communication with a fuel tank. The first canister device or the first absorbent chamber is filled with a first activated carbon adapted for absorbing the vapors of hydrocarbons evaporated in the float chamber while the second canister device or the second absorbent chamber is filled with a second activated carbon capable of absorbing efficiently and completely the vapors of hydrocarbons evaporated in the fuel tank. Thus the emission of the fuel vapor into the surrounding atmosphere may be completely avoided.

So far two kinds of activated carbons have been described as being used as absorbents for absorbing the fuel vapor, but it will be understood that any suitable absorbents capable of absorbing the fuel vapor may be used. Furthermore it may be proposed to use two types of absorbents consisting of porous inorganic carriers coated with fuel vapor absorbing agents. When the absorbents have lost their capabilities of absorbing the fuel vapor after long periods of operation, they must be replaced with new ones or may be heated so as to be activated again.

The evaporated fuel vapor trapping device in accordance with the present invention can trap the fuel vapor evaporated in the fuel feed system of the internal combustion engine so that the emission of the fuel vapor into the surrounding atmosphere may be prevented and consequently the atmospheric pollution problems may be overcomed.

What is claimed is

1. In a fuel feed system of an internal combustion engine comprising a carburetor with a float chamber and a fuel tank, an evaporated fuel vapor trapping device of the type for trapping the vapors of the fuels evaporated in the float chamber of the carburetor and in the fuel tank characterized by comprising:

(a) a first canister device which has its one end communicated with the space above the fuel in said float chamber and with the high suction in the carburetor and its the other end opened at the surrounding atmosphere and which is filled with a first absorbent capable of absorbing vapors of hydrocarbons up to and including those with high carbon numbers, and (b) a second canister device which has its one end communicated with the space above the fuel in said fuel tank and with the high suction in said carburetor and its the other end opened at the surrounding atmosphere and which is filled with a second absorbent capable of absorbing vapors of hydrocarbons having relatively low carbon numbers, the volume of said second canister device being greater than that of said first canister device.

2. An evaporated fuel vapor trapping device as set forth in claim 1 further characterized in that said first absorbent capable of absorbing vapors of hydrocarbons upto and including those with high carbon numbers comprises activated carbon capable of absorbing the vapors of hydrocarbons having the carbon numbers upto and including seven, and said second absorbent capable of absorbent vapors of hydrocarbons having relatively low carbon numbers comprises activated carbon capable of absorbing the vapors of hydrocarbons having carbon numbers upto and including four.

3. An evaporated fuel vapor trapping device as set forth in claim 1 further characterized in that said the other ends of said first and second canister devices are communicated with the surrounding atmosphere through filter means.

4. In a fuel feed system of an internal combustion engine comprising a carburetor with a float chamber and a fuel tank, an evaporated fuel vapor trapping device of the type for trapping the vapors of the fuels evaporated in the float chamber of the carburetor and in the fuel tank characterized by comprising a single canister device divided by a partition wall into first and second absorbent chambers, said first absorbent chamber having its one end communicated with the space above the fuel in said float chamber and with the high suction in said carburetor and its other end opened at the surrounding atmosphere and said first absorbent chamber being filled with a first absorbent capable of absorbing vapors of hydrocarbons with high carbon numbers including those with carbon numbers up to and including seven, and said second absorbent chamber having its one end communicated with the space above the fuel in said fuel tank and with thehigh suction in said carburetor and its other end opened at the surrounding atmosphere and said second absorbent chamber being filled with a second absorbent capable of absorbing vapors of hydrocarbons having relatively low carbon numbers including those with carbon numbers up to and including four, the volume of said second absorbent chamber being greater than that of said first absorbent chamber.

5. An evaporated fuel vapor trapping device as set forth in claim 4 further characterized in that said the other ends of said first and second absorbent chambers are communicated with the surrounding atmosphere through filter means.

* * * * *